US008866560B2

(12) United States Patent
Nealis et al.

(10) Patent No.: US 8,866,560 B2
(45) **Date of Patent: *Oct. 21, 2014**

(54) SYSTEMS AND METHODS FOR A STACKED WAVEGUIDE CIRCULATOR

(71) Applicant: Aviat U.S., Inc., Santa Clara, CA (US)

(72) Inventors: Edwin Nealis, Cary, NC (US); Ying Shen, Chapel Hill, NC (US)

(73) Assignee: Aviat U.S., Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/907,376

(22) Filed: May 31, 2013

(65) Prior Publication Data

US 2013/0271347 A1 Oct. 17, 2013

Related U.S. Application Data

(63) Continuation of application No. 13/249,207, filed on Sep. 29, 2011, now Pat. No. 8,552,809.

(60) Provisional application No. 61/388,486, filed on Sep. 30, 2010.

(51) Int. Cl.
*H01P 1/39* (2006.01)
*H01P 1/38* (2006.01)

(52) U.S. Cl.
CPC ... *H01P 1/38* (2013.01); *H01P 1/39* (2013.01)
USPC ..... 333/1.1

(58) Field of Classification Search
USPC ..... 333/24.2, 1.1
See application file for complete search history.

(56) References Cited

U.S. PATENT DOCUMENTS

| | | | | |
|---|---|---|---|---|
| 2,848,688 | A | 8/1958 | Fraser | |
| 2,849,685 | A | 8/1958 | Weiss | |
| 3,011,134 | A | 11/1961 | Reingold | |
| 3,020,494 | A | 2/1962 | Chiron | |
| 5,709,811 | A | 1/1998 | Satoh et al. | |
| 6,407,646 | B1 | 6/2002 | Johnson | |
| 7,719,384 | B1 | 5/2010 | Arceo et al. | |
| 8,552,809 | B2 * | 10/2013 | Nealis et al. | 333/1.1 |
| 2002/0212446 | | 10/2004 | Brown et al. | |

OTHER PUBLICATIONS

International Application No. PCT/US2011/054189, International Search Report and Written Opinion mailed Jun. 4, 2012.

* cited by examiner

*Primary Examiner* — Stephen Jones
(74) *Attorney, Agent, or Firm* — Sheppard, Mullin, Richter & Hampton LLP

(57) ABSTRACT

Systems and methods for a stacked waveguide circulator are described. The stacked waveguide circulator may comprise a first side and a second side. The stacked waveguide circulator may also comprise a top and a bottom opposite the top. The top and the bottom may be adjacent to the first and second sides. The stacked waveguide circulator may also comprise a a first port and a second port on the first side. The first port may be vertically above the second port on the first side. Further, the stacked waveguide circulator may comprise a third port on the second side. The stacked waveguide circulator may comprise a first magnet on the top. The first magnet may be configured to assist in directing signals between the first, second, and third ports.

18 Claims, 12 Drawing Sheets

SYSTEMS AND METHODS FOR A STACKED WAVEGUIDE CIRCULATOR

CROSS-REFERENCE TO RELATED APPLICATIONS

The present application is a continuation of and claims the benefit of U.S. patent application Ser. No. 13/249,207 filed Sep. 29, 2011, entitled "SYSTEMS AND METHODS FOR A STACKED WAVEGUIDE CIRCULATOR," which claims the benefit of U.S. Provisional Patent Application No. 61/388,486 filed Sep. 30, 2010, entitled "Compact Antenna Combining Unit for Point-to-Point Wireless Communications and Associated Circulator Components," each of which is incorporated by reference herein.

BACKGROUND

1. Field of the Invention(s)

The present invention(s) generally relate to waveguide circulators. More particularly, the invention(s) relate to systems and methods for stacked waveguide circulators.

2. Description of Related Art

Typical point-to-point wireless communications systems commonly combine transmit and receive signals to and from antennas using antenna combining units of some form. In some examples, a single transmit signal can be combined with a single receive signal, multiple transmit signals can be combined together, multiple receive signals can be combined together, and multiple transmit signals can be combined with multiple receive signals. Combining of signals allows for sharing of expensive antenna systems by multiple transmitters and/or receivers, either for multiple data paths and/or for signal protection.

There are several common techniques to combine signals in the prior art. For example, a diplexer may combine a single transmit signal with a single receive signal. Unfortunately, diplexers only allow one transmit and one receive signal to be combined. Further, diplexers allow for little flexibility and few options for expansion. In another example, filters with coaxial connectors connected with coaxial circulators and coaxial cables may be used to combine signals. The disadvantage of using coaxial cable and coaxial circulators to connect filters is the introduction of power loss into the path. Anther technique to combine signals is to use filters with waveguide flanges which may be connected together with waveguide circulators in the prior art.

FIG. 1 depicts a waveguide circulator 100 in the prior art. Typically, waveguide circulators 100 include three ports including one port per side of the waveguide circulator 100. The waveguide circulator 100 has three ports 102, 104, and 106 including one port on each of three sides. The waveguide circulator 100 also has three flanges 108, 110, and 116 around each port 102, 104, and 106, respectively. The ports 102, 104, and 106 are used for transferring wave energy in a non-reciprocal manner, such that when wave energy is fed into one port, it is transferred to the next port only. In order to enable the non-reciprocal energy transfer, waveguide circulators include ferrite resonators to which are applied a magnetic field via one or more magnets or electromagnets. The flanges are used to couple the waveguide circulator 100 with waveguides and/or filters. Unfortunately, waveguide circulators 100 and waveguide fittings used to connect filters with waveguide flanges tend to be large and consume considerable space. In order to combine a transmitter and a receiver to a waveguide circulator 100, the connection to the transmitter must be at a right angle or 180 degrees to the connection to the receiver. As such, it is difficult to combine multiple waveguide circulators with multiple filters, transmitters, and/or receivers in a limited space.

SUMMARY OF THE INVENTION

Systems and methods for a stacked waveguide circulator are described. The stacked waveguide circulator may comprise a first side and a second side. The stacked waveguide circulator may also comprise a top and a bottom opposite the top. The top and the bottom may be adjacent to the first and second sides. The stacked waveguide circulator may also comprise a first port and a second port on the first side. The first port may be vertically above the second port on the first side. Further, the stacked waveguide circulator may comprise a third port on the second side. The stacked waveguide circulator may comprise a first magnet on the top. The first magnet may be configured to assist in directing signals between the first, second, and third ports.

The stacked waveguide circulator may be configured to receive a signal from the first or second port on the first side and direct the signal to the third port on the second side. The stacked waveguide circulator may be configured to receive a signal from the third port on the second side and direct the signal to the first or second port on the first side.

The stacked waveguide circulator may further comprise a second magnet on the bottom of the stacked waveguide circulator. The stacked waveguide circulator may further comprise a fourth port on the second side of the stacked waveguide circulator, the fourth port being vertically below the third port. Further, the second magnet may be configured to assist in directing signals between the first, second and fourth ports. The first magnet comprises a rare earth magnet.

In some embodiments, an internal structure of the stacked waveguide circulator defines a central cavity configured to receive signals from the first, second, and third ports. The first and second ports may be coupled to a transmitter filter and a receive filter, respectively. The third port may be coupled to an antenna waveguide which is coupled with an antenna. The fourth port is coupled to a transmit filter or receiver filter.

An exemplary system may comprise a stacked waveguide circulator, a first transmit filter, a first receive filter, and an antenna waveguide component. The stacked waveguide circulator may comprise a first side, second side, top and bottom. The top may be opposite the bottom. The top and bottom may be adjacent to the first and second sides. The first side may further comprise a first port and a second port. The first port may be above the second port. The second side may comprise a third port. The top of the stacked waveguide circulator may comprise a first magnet. The first transmit filter may be coupled to a transmitter and the first port on the first side of the stacked waveguide circulator. The first receive filter may be coupled to a receiver and the second port on the first side of the stacked waveguide circulator. The first receive filter may be stacked with the first transmit filter. The antenna waveguide may be coupled to the third port on the second side of the stacked waveguide circulator. The stacked waveguide circulator may be configured to receive signals from the transmit filter and the antenna filter and provide signals to the antenna filter and the receive filter.

The stacked waveguide circulator may be configured to receive a signal from the transmit filter on the first side and direct the signal to the antenna waveguide on the second side. The stacked waveguide circulator may be configured to receive a signal from the antenna waveguide via the third port and provide the signal to the receive filter.

The stacked waveguide circulator may be configured to receive a signal from the antenna waveguide via the third port, provide the signal to the first transmit filter via the first port, receive the signal from the first transmit filter via the first port, and provide the signal to the first receive filter via the second port. The first transmit filter may be configured to receive the signal from the stacked waveguide circulator via the first port and return the signal to the stacked waveguide circulator via the first port. The signal may be returned because the signal is from a channel that may not traverse the transmit filter.

In some embodiments, the second side of the stacked waveguide circulator may further comprise a fourth port and the bottom of the stacked waveguide circulator comprises a second magnet configured to direct signals to or from the fourth port. A second transmit filter may be coupled to a second transmitter and to the fourth port. The stacked waveguide circulator may be configured to receive a signal from the second transmitter via the second transmit filter over the fourth port and direct the signal to the antenna via the third port. A second receive filter may be coupled to a second receiver and to the fourth port. The stacked waveguide circulator may be configured to receive a signal from the antenna via the third port and direct the signal to the second receiver via the second receive filter via the fourth port.

An exemplary method may comprise receiving, by a stacked waveguide circulator, a first signal from a transmitter, the first signal being received by a first port on a first side of the stacked waveguide circulator, directing, by the stacked waveguide circulator, the first signal to an antenna via a third port on a second side of the stacked waveguide circulator, receiving, by the stacked waveguide circulator, a second signal from the antenna via the third port of the stacked waveguide circulator, and directing, by the stacked waveguide circulator, the second signal from the antenna to a receiver via a second port, the second port being on the first side of the stacked waveguide circulator and being vertically below the first port.

Another exemplary system may comprise a stacked waveguide circulator, a first receive filter, and a first transmit filter. The stacked waveguide circulator may comprise a first side, second side, top and bottom. The top may be opposite the bottom. The top and bottom may be adjacent to the first and second sides. The first side may further comprise a first port and a second port. The first port may be above the second port, and the second side may further comprise a third port. The top of the stacked waveguide circulator may comprise a first magnet. The first receive filter may be coupled to a receiver and the first port on the first side of the stacked waveguide circulator. The first transmit filter may be coupled to a transmitter and the second port on the first side of the stacked waveguide circulator. The first transmit filter may be stacked with the first receive filter. The antenna waveguide may be coupled to the third port on the second side of the stacked waveguide circulator. The stacked waveguide circulator may be configured to receive signals from the transmit filter and the antenna filter and provide signals to the antenna filter and the receive filter.

DETAILED DESCRIPTION OF THE INVENTION

Various embodiments of systems and methods described herein discuss a stacked waveguide circulator as well as the use of a stacked waveguide circulator with antenna combining units and radio frequency units that may be used with a wireless communication system. The wireless communication system may be, for example, a microwave wireless communication system. In some embodiments, several stacked waveguide circulators may be used in conjunction with several transmit filters, receive filters, receivers, transmitters, and antenna waveguides. The stacked waveguide circulator may allow for more components to be placed together in an apparatus (e.g., a rack) thereby potentially allowing additional receivers and/or transmitters within a rack and/or local facility.

In some embodiments, the stacked waveguide circulator allow for the creation of a compact antenna combining system for point-to-point microwave equipment. Stacked circulator components may be designed to allow compact system design. Stacked filter configurations and the design of stacked waveguide circulators with integrated interconnection may allow for great flexible in antenna coupling unit (ACU) configuration in a very compact area with reduced or minimal power loss.

In various embodiments, one or more stacked waveguide circulators may reduce or minimize a size of ACU. The stacked waveguide circulators may allow for a greater level of flexibility. As a result, multiple configurations of one or more ACUs may be created through the use of a few common building blocks. Further the cost of building and configuring an ACU may be reduced by reducing or eliminating costly interconnection parts and large support structures.

Figure 1:
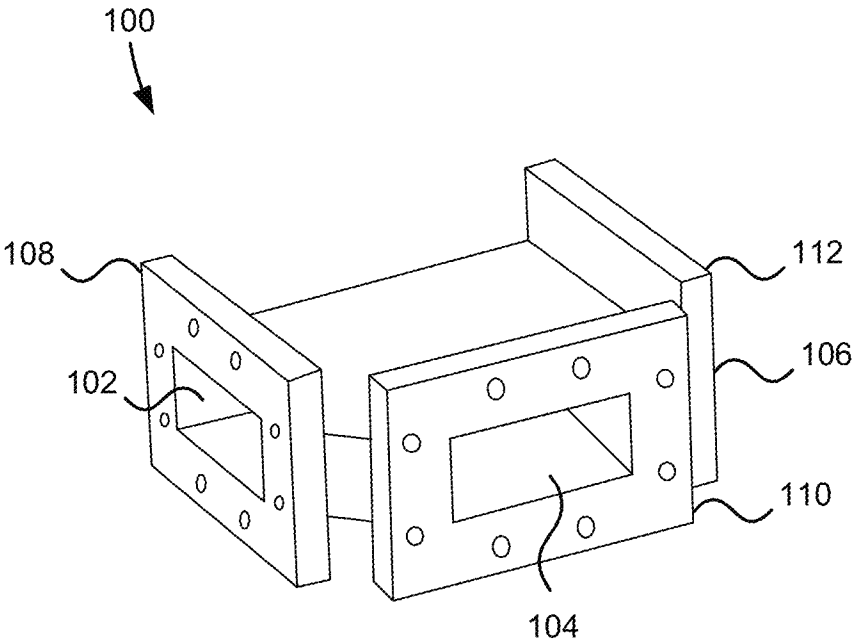
FIG. 1 Prior Art
FIG. 1 depicts a waveguide circulator in the prior art.
Figure 2:
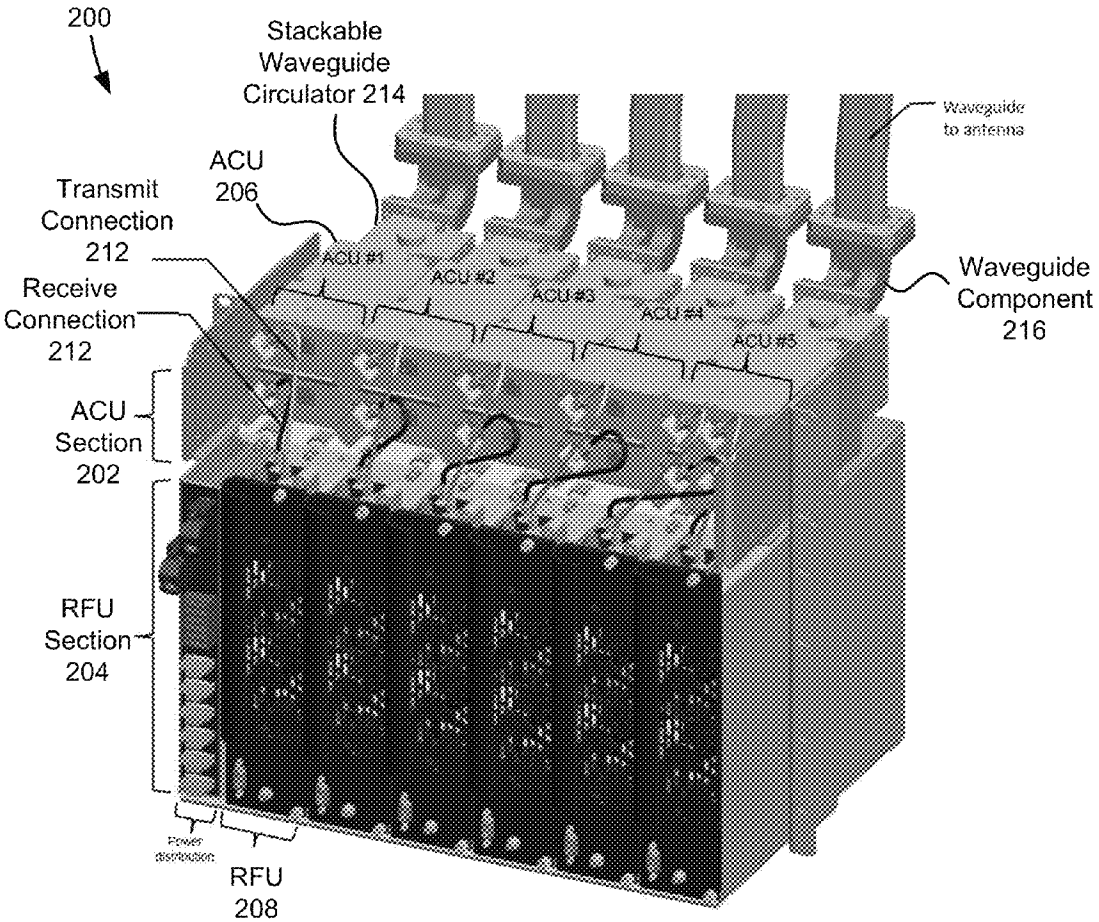
FIG. 2 depicts a rack with five compact antenna combing units (ACU) installed with an RF unit section in some embodiments.

FIG. 2 depicts a rack 200 with five compact antenna combing units (ACUs) 206 installed with an RFU section 204 in some embodiments. The RFU section 204 houses multiple RF units (RFUs) 208. Each RFU 208 may comprise a transmitter and/or a receiver configured to provide signals to and receive signals from an antenna. Each RFU 208 has a transmitter output 210 and receiver input 212 that are connected via coaxial cable to an ACU 206. The ACU section 202 comprises five ACUs 206. Each ACU 206 is includes a transmit filter coupled to the transmitter in the RFU 208, a receive filter coupled to a receiver in the RFU 208, and a stacked waveguide circulator 214 which is coupled to an antenna via a waveguide component 216. ACUs 206 can be configured to have multiple antenna connections if desired.

As discussed herein, an ACU may comprise a transmit filter and a receive filter coupled with at least one RFU 208. The ACU may also comprise a stacked waveguide circulator 214 (see FIGS. 5*a* and 5*b*) configured to couple with the transmit and the receive filters on one side of the stacked waveguide circulator 214. The stacked waveguide circulator 214 is also coupled with the waveguide component 216 (e.g., an E-bend, H-bend, or other waveguide that may direct a signal to or from an antenna) on a second side of the stacked waveguide circulator 214. In some embodiments, the second side of the stacked waveguide circulator 214 may be opposite to or adjacent to the first side.

In various embodiments, physical space may be saved and a number of waveguide and/or microwave components may be reduced by utilizing a stacked waveguide circulator 214. The stacked waveguide circulator 214 may allow for the transmit filter and the receive filter to be stacked (e.g., one on top of the other). Further, waveguide components (e.g., E-bends, H-bends, or the like) may be necessary to direct signals between the transmit filter, receive filter, and antenna.

Although FIG. 2 depicts five RFU sections 204, five ACUs 206, and five stacked waveguide circulators 214, those skilled in the art will appreciate that there may be any number of RFU sections 204, ACUs 206, and stacked waveguide circulators 214.

Figure 3:
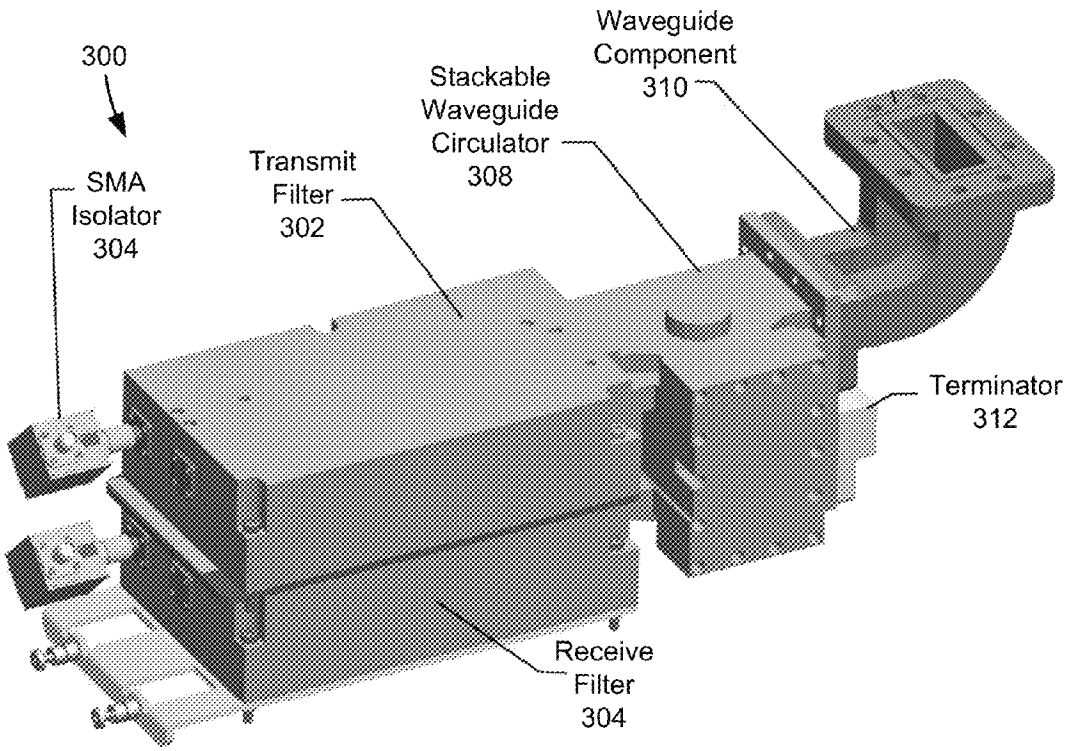
FIG. 3 depicts a front view of a compact antenna combing unit (ACU) in some embodiments.

FIG. 3 depicts a front view of a compact antenna combing unit (ACU) 300 in some embodiments. The ACU comprises a transmit filter 302, a receive filter 304, an SMA isolator 306, a stacked waveguide circulator 308, a waveguide component 310, a terminator 312. The transmit filter 302 may be coupled to the transmitter or receiver.

The transmit filter 302 may be configured to receive signals from a transmitter and provide the signals to the antenna via the stacked waveguide circulator component 308 and the waveguide component 310. The transmit filter 302 is a filter that may reduce or eliminate undesired aspects (e.g., noise) of a signal to be transmitted from a transmitter to the antenna. The transmit filter 302 may be, for example, a bandpass filter or the like. The transmit filter 302 may comprise any number of filters.

In some embodiments, the transmit filter 302 prevents signals from being provided from the stacked waveguide circulator 308 to the transmitter. In one example, if a signal is provided through the transmit filter 302 to the transmitter (e.g., a signal is provided from an antenna and the stacked circular waveguide 308 provides the signal through the transmit filter 302), the transmit filter 302 may block the signal. Subsequently the signal may be returned or reflected back to the stacked waveguide circular 308 which may redirect the signal to the next port (e.g., the receive filter 304).

The receive filter 304 may be configured to receive signals from an antenna (via the stacked waveguide circulator component 308 and the waveguide component 310) and provide the signals to the receiver. The receive filter 304 is a filter that may reduce or eliminate undesired aspects (e.g., noise) of a received signal from the antenna. The receive filter 304 may be, for example, a bandpass filter or the like. The receive filter 304 may comprise any number of filters.

The transmit filter 302 and the receiver filter 304 may be stacked with one filter being on top of the other. Although FIG. 3 depicts the transmit filter 302 being on top of the receive filter 304, in some embodiments, the receive filter 304 may be on top of the transmit filter 302. Both filters may be coupled to the same side of the stacked waveguide circulator 308.

The transmit filter 302 and receive filter 304 may be coupled together. In some embodiments, the transmit filter 302 rests on the receive filter 304 or the receive filter 304 rests on the transmit filter 302. In some embodiments, the transmit filter 302 and the receive filter 304 do not come into contact. In various embodiments, the transmit filter 302 and the receive filter 304 are secured by bracket or other mounting member. The bracket or other mounting member may be in between the transmit filter 302 and the receive filter 304.

The SMA isolator 306 is an SubMinitature version A (SMA) coaxial RF connector coupled between a filter and a transmitter or receiver. In one example, the SMA isolator 306 may transmit microwave or radio frequency power in one direction. The SMA isolator may shield equipment. The SMA isolator 306 may be coupled to the transmit filter 302 and a transmitter (e.g., a transmitter within the RF unit as depicted in FIG. 2). In another example, the SMA isolator 306 is coupled to the receiver filter 304 and a receiver (e.g., a receiver within the RF unit).

In some embodiments, the SMA isolator 306 prevents signals from being provided through the transmit filter 302 back to the transmitter. If a signal is provided through the transmit filter to the transmitter (e.g., a signal is provided from an antenna and the stacked circular waveguide 308 provides the signal through the transmit filter 302), the SMA isolator 306 may block the signal. Subsequently the signal may be returned or reflected back to the stacked waveguide circular 308 which may redirect the signal to the next port (e.g., the receive filter 304).

The stacked waveguide circulator 308 is a waveguide circulator with at least two ports on a single side and at least one port on another side. The stacked waveguide circulator 308 may direct signals from one port on one side of the circulator to at least one of the ports on another side. The stacked waveguide circulator 308 may comprise an interior structure that defines a cavity that may direct signals from port to port.

The stacked waveguide circulator 308 may comprise a first magnet at the top of the circulator. The magnet may be a rare earth magnet and configured to direct signals between the port with the receive filter 304, the port with the transmit filter 302, and the port that is directed towards the antenna.

In various embodiments, the stacked waveguide circulator 308 comprises a fourth port. In FIG. 3, the fourth port is on the same side as the port that is coupled to the waveguide component 310. The fourth port is depicted as being coupled to a terminator 312 which may functionally close the port (e.g., the stacked waveguide circulator 308 will not provide or receive signals from the terminator 312).

Although FIG. 3 depicts a terminator 312, the fourth port may be coupled to another receive filter, transmit filter, waveguide component, or waveguide circulator. In some embodiments, the fourth port may be coupled to a receive filter. In this example, the waveguide circulator may be coupled to two receive filters that may be able to receive signals on two different channels. For example, if a signal arrives over a first channel, the stacked waveguide circulator 308 may direct the signal to the receive filter 304. If the receive filter 304 and/or SA isolator 306 is configured to receive the signal (e.g., the channel is acceptable), the receiver may receive the filtered signal over the channel. If the receive filter 304 and/or SA isolator 306 is not configured to receive the signal, the signal may be return to the stacked waveguide circulator 308 to be redirected to the fourth port and the other receive filter. Those skilled in the art will appreciate that different receive filters may be configured to accept signals of different channels.

In some embodiments, when the stacked waveguide circulator 308 comprises the fourth port, the stacked waveguide circulator 308 may comprise a magnet on the bottom which may assist in directing signals to and from the fourth port and one or more of the other ports. The bottom magnet may be of the same type as the magnet at the top. Alternately, the bottom magnet may be of a different type (e.g., the bottom magnet comprises different material than the top magnet) or the bottom magnet may have different magnetic properties.

The waveguide component 310 may couple a port on the second side of the stacked waveguide circulator 308 to the antenna or a waveguide configured to propagate energy to be transmitted to the antenna. Although a waveguide component 310 is depicted as an E-bend in FIG. 3, those skilled in the art will appreciate that n waveguide may be used (e.g., H-bend).

In various embodiments, the ACU is comprised of one transmit filter 302, one receive filter 304, SMA isolators 306, the stacked circulator component 308, a waveguide component 310, and a terminator 312. A transmit signal may enter the ACU through the SMA isolator 306 installed to the transmit filter 302. The signal may be filtered by the transmit filter 302 and enters the stacked circulator component 308 where the signal may be passed through the E-bend 310 to the antenna. The receive signal may be passed from the antenna, through the waveguide component 310, through the stacked circulator component 308, and directed to the receive filter 304. In some embodiments, a receive signal may be filtered and passed through the SMA isolator 306 installed on the receive filter 304. The terminator 312 covers the expansion port (e.g., the fourth port on the same wall of the stacked waveguide circulator 308 as the port coupled to the waveguide component 310) when it is not used. The expansion port may allow signals to be injected and/or received into/from the stacked waveguide circulator 308.

Figure 4:
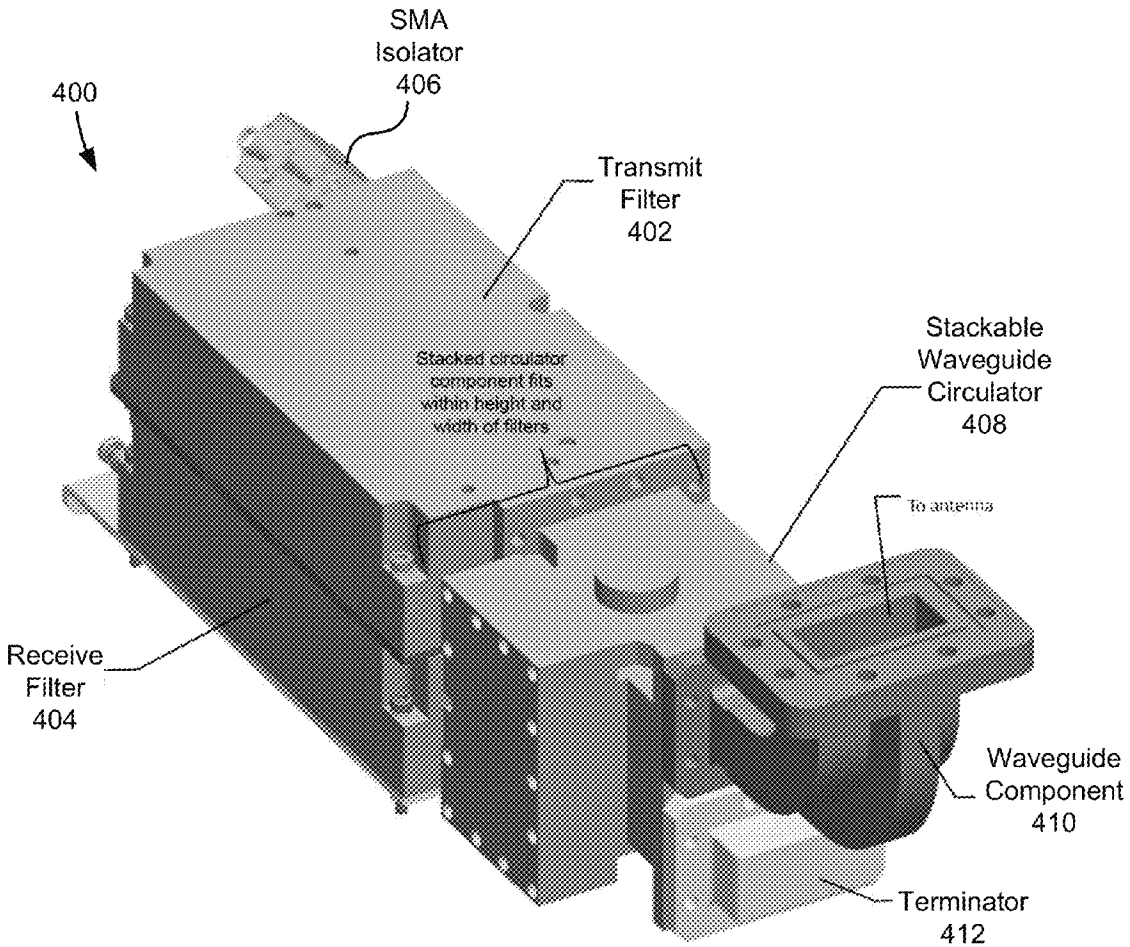
FIG. 4 depicts a rear view of a compact antenna combing unit (ACU) in some embodiments.

FIG. 4 depicts a rear view of a compact antenna combing unit (ACU) in some embodiments. The ACU in FIG. 4 is similar to the ACU in FIG. 3. The ACU in FIG. 4 depicts a transmit filter 402, a receive filter 404, a SMA isolator 406, a stacked waveguide circulator 408, a waveguide component 410, and a terminator 412. The transmit filter 402, receive filter 404, SMA isolator 406, stacked waveguide circulator 408, waveguide component 410, and terminator 412 may be similar to the transmit filter 302, receive filter 304, SMA isolator 306, stacked waveguide circulator 308, waveguide component 310, and terminator 312 of FIG. 3.

The stacked waveguide circulator 408 may be designed to fit within the height and width of the filters (i.e., the transmit filter 402 and the receive filter 404) to allow another ACU to be installed on one or both sides of the ACU. Stacking the filters (e.g., the transmit filter 402 and the receive filter 404) and fitting the stacked circulator component 408 in the profile of the filters may allow for a very compact system of ACUs. It also may allow for installation and servicing of one ACU without impacting adjacent ACUs.

Figures 5A, 5B:
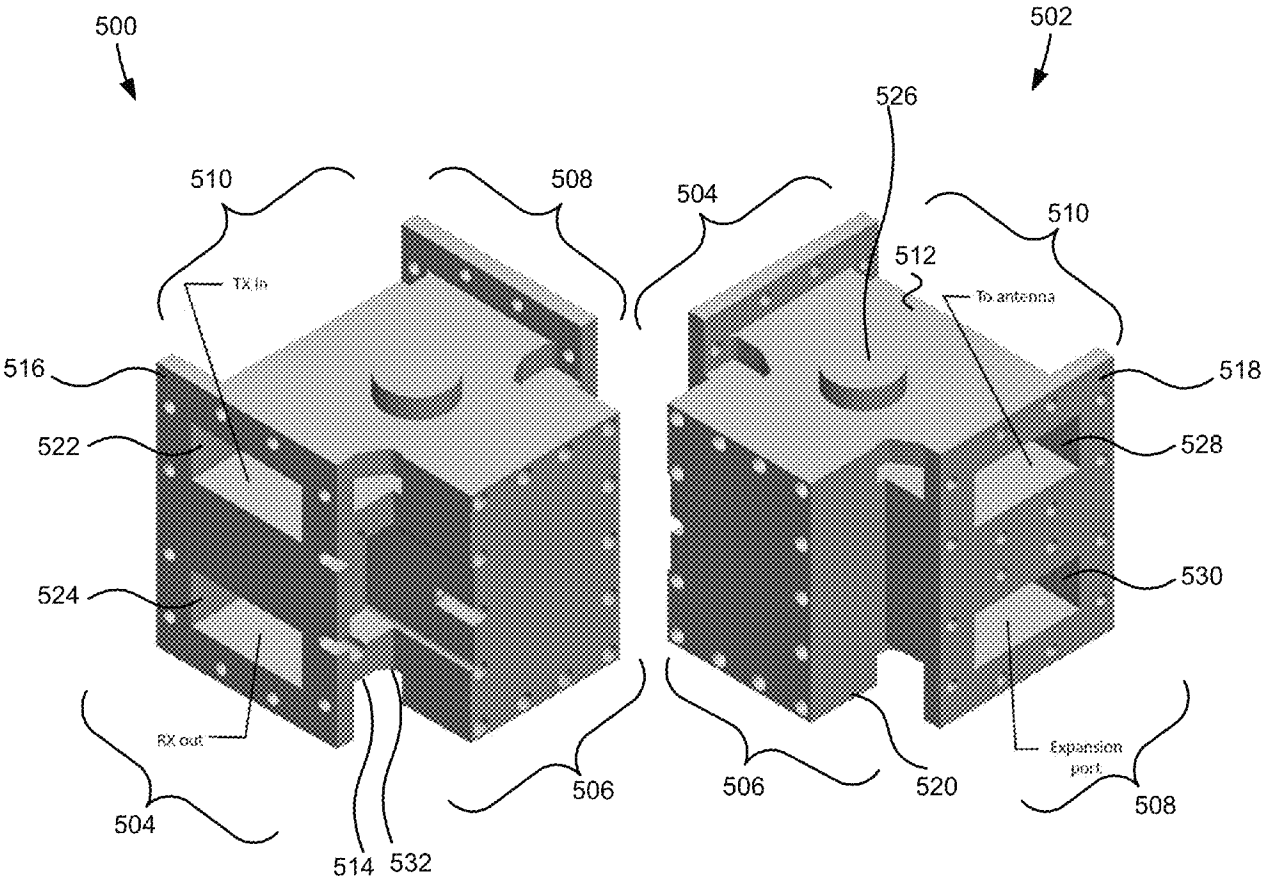
FIG. 5*a* depicts a view of a first and second side of a stacked waveguide circulator in some embodiments.
FIG. 5*b* depicts a view of a second and third side of the stacked waveguide circulator in some embodiments.

FIG. 5*a* depicts a view of first and second sides (sides 504 and 506) of a stacked waveguide circulator 500 in some embodiments. FIG. 5*b* depicts a view of second and third sides (sides 506 and 508) of the stacked waveguide circulator in some embodiments. In various embodiments, the stacked waveguide circulator 500 is not simply two separate waveguide circulators attached together, rather, the single stacked waveguide circulator 500 is directed to sending and receiving signals from the three or more ports. At least two of the ports of the stacked waveguide circulator 500 may be vertically positioned, one above the other, on a side of the stacked waveguide circulator 500. The stacked waveguide circulator 500 may comprise a single interior chamber through which the signals are provided and received through the three or more ports.

In various embodiments, the stackable waveguide circulator 500 is a non-reciprocal ferrite device. The stacked waveguide circulator 500 comprises four sides 504, 506, 508, and 510. Side 504 of the stacked waveguide circulator 500 comprises two ports including a transmit port 522 which is vertically above a receive port 524. Side 508 may also comprise two ports including an antenna port 528 which is vertically above an expansion port 530 (See FIG. 5B).

The waveguide circulator 500 comprises a top 512 opposite a bottom 514. Port 522 may be positioned vertically above port 524 (i.e., towards the top 512 of the waveguide circulator 500). Similarly, port 528 may be positioned vertically above port 530. Side 504 also includes a flange 516. Side 508 may include a flange 518. The flanges 516 and 518 may be configured to couple to two or more waveguide components such as a waveguide filter (e.g., receiving waveguide filter or transmission waveguide filter) or other waveguide components.

Multiple waveguide components may be coupled to a flange. For example, flange 516 may be coupled to a transmit filter (e.g., the transmit filter being coupled to the transmit port 522) and a receive filter (e.g., the receive filter being coupled to the receive port 524). The transmit filter and receive filter may be stacked, one over the other, and coupled to the same flange 516. Similarly, flange 518 may also be coupled to multiple waveguide components. For example, the flange 518 may be coupled to a waveguide component (i.e., a waveguide that is coupled either directly or indirectly to an antenna). The waveguide component may be coupled to antenna port 528. Further, the flange 518 may also be coupled to a terminator, receive filter, waveguide circulator, transmit filter, E-bend, H-bend, or any other waveguide component. In one example, a terminator is coupled to the expansion port 530.

The waveguide circulator 500 may also comprise a magnet 526 at the top 512 as well as a magnet 532 at the bottom 514 of the waveguide circulator 500. In various embodiments, sides 506 and 510 do not have any open ports. Side 506 may comprise a section 520.

The magnets 526 and 532 may assist in directing signals between ports. The magnets 526 and 532 may be any magnetic material including, but not limited to, rare earth magnets. In various embodiments, the magnets 526 and 532 assist in directing signals in a non-reciprocal manner. The magnetic fields of the magnets 526 and/or 532 may redirect the signals between the different ports. In some embodiments, the bottom magnet 532 assists in directing signals from and to the expansion port 530. If the expansion port 530 is terminated or is otherwise not present (See FIGS. 10A and 10B), the bottom magnet 532 may be unnecessary.

In various embodiments, the waveguide circulator 500 may be a clockwise or a counterclockwise circulator. For example, transmission signals entering the transmit port 522 may exit the antenna port 528. Signals entering the antenna port 528 (i.e., receiving signals) may be directed to the expansion port 530. If the expansion port 530 is terminated, the signals may then be directed to the receive port 524. If the expansion port 530 is not terminated but is coupled to a transmit filter, the transmit filter may reject the signal and the signal may then be redirected by the stackable waveguide circulator 500 to the receive port 524. If the expansion port 530 is not terminated but is coupled to a receive filter, the receive filter may receive the signal. In some embodiments, if the receiving signal from the antenna port 528 is directed to a different channel, the receive filter may reject the signal and the signal may then be redirected to the receive port 524.

Figure 6:
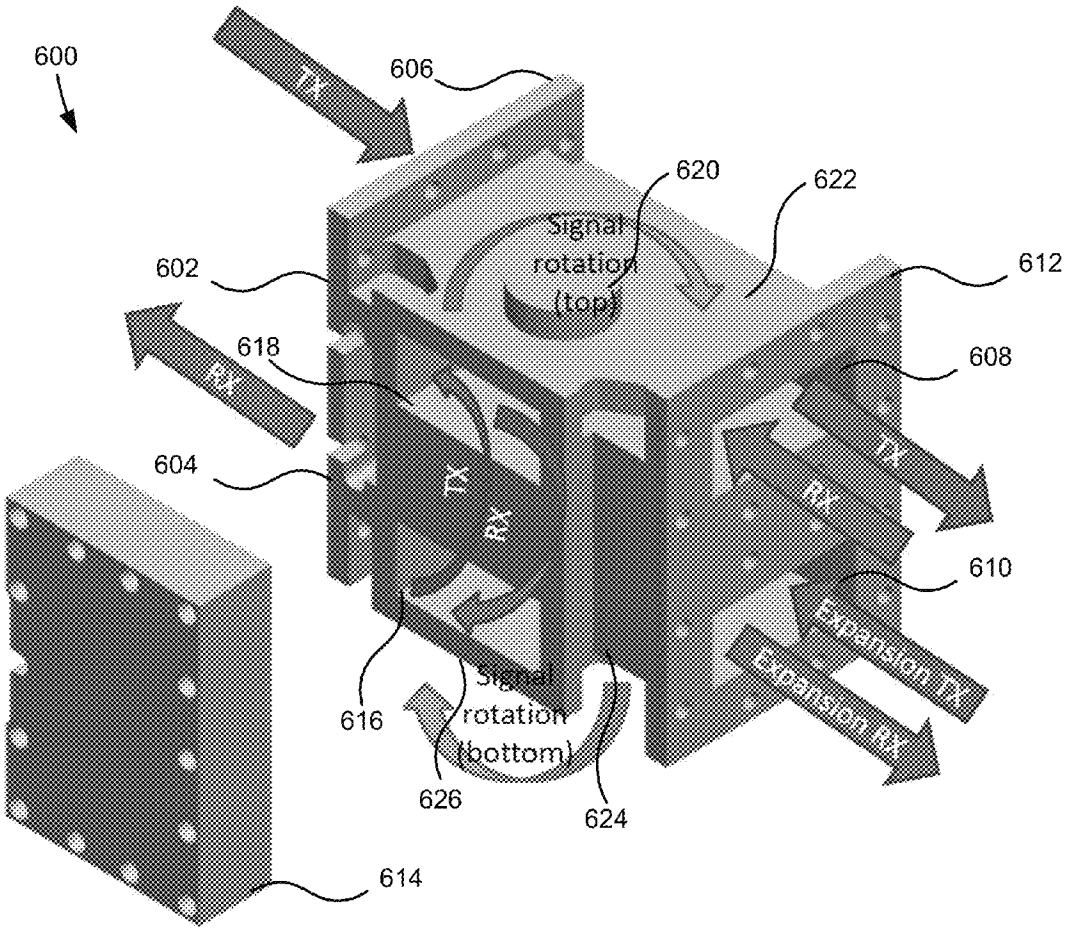
FIG. 6 is an exploded view of the stacked waveguide circulator in some embodiments.

FIG. 6 is an exploded view of the stacked waveguide circulator 600 in some embodiments. In various embodiments, the section 614 that couples the top circulator function 618 to the bottom circulator function 616 has been removed. The directions of signal rotation are shown along with signal paths. By integrating the function of two circulators and connection waveguide sections into a single component, the space required is reduced and/or minimized.

The stacked waveguide circulator 600 comprises a transmit port 602 above the receive port 604 on the same side. The stacked waveguide circulator 600 further comprises an antenna port 608 (e.g., a port that is coupled to an antenna or a waveguide that directs energy to and from the antenna) above the expansion port 610. The stacked waveguide circulator 600 comprises a top 622 and a bottom 624.

A first magnet 620 on the top and a second magnet 626 may be on the bottom. The magnets may be different types. In some embodiments, the first magnet 620 and the second magnet 626 may share common magnetic properties. In one example, the first magnet 620 may direct signals in a clockwise direction while the second magnet 626 may direct signals in a clockwise or counter-clockwise direction.

FIG. 6 demonstrates how signals may enter, leave, and circulate within the stacked waveguide circulator 600. For example, the transmission signal may enter the transmit port 602 and be directed out of the antenna port 608. Receive signals may be received from the antenna port 608 and be directed to the receive port 604.

In some embodiments, the expansion port 610 is coupled to another transmitter via a transmit filter. For example, the transmitter may provide an expansion transmit signal that is received by the expansion port 610 and directed to the antenna port 608. The expansion port 610, in some embodiments, may be coupled to another receiver via a receive filter. For example, the antenna may provide a signal through the antenna port 608 of the stacked waveguide circulator 600 which directs the signal to the expansion port 610.

In various embodiments, the stacked waveguide circulator 600 may direct the signal to a port that rejects, reflects, or otherwise returns the signal to the stacked waveguide circulator 600 which may then direct the signal to another port in turn. For example, a signal from the antenna that is to be received by the expansion port 610 may be first be directed to the transmit port 602. The transmitter, transmit filter, and/or SMA isolator may provide the signal back to the transmit port 602. The stacked waveguide circulator 600 may then direct the signal to the next port which, in this case, is receive port 604. If the signal is not the right carrier, the signal may be rejected, reflected, or otherwise returned to the stacked waveguide circulator 600 which may direct the signal to the expansion receiver on the expansion port 610.

Figure 7:
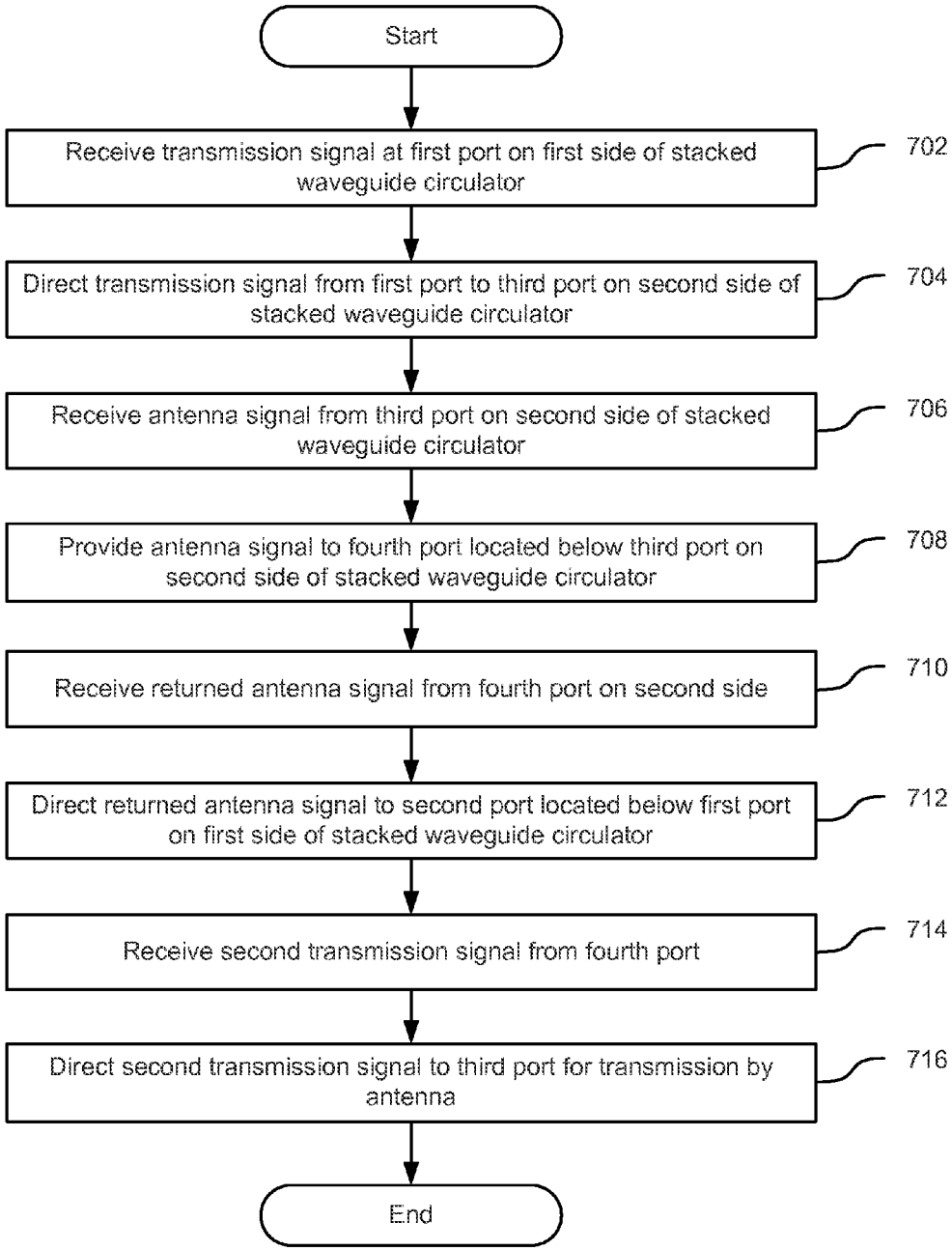
FIG. 7 is a flowchart depicting a method of using the stacked waveguide circulator in some embodiments.

FIG. 7 is a flowchart depicting a method of using the stacked waveguide circulator 508 in some embodiments. In step 702, a first transmit port 522 on a first side 504 of a stacked waveguide circulator 500 may receive a transmission signal from a transmitter via a transmit filter. In step 704, the stacked waveguide circulator 508 directs the signal from the first transmit port 522 to the third antenna port 528 on a second side 508. The magnet 526 and/or magnet 532 may assist in directing the signal to the antenna port 528.

In step 706, the antenna port 528 on the second side 508 of the stacked waveguide circulator 500 may receive an antenna signal. In step 708, the stacked waveguide circulator 508 directs the signal from the antenna port 528 to the expansion port 530 on the second side. The transmit filter and/or SMA isolator may reject and/or otherwise provide the signal back to the stacked waveguide circulator 508. In one example, the transmit filter and/or SMA isolator may reject any signal being provided back towards a transmitter. In some embodiments, the transmit filter and/or SMA isolator may reject signals that are the wrong phase, amplitude, and/or channel.

In step 710, the stacked waveguide circulator 508 receives the returned antenna signal from the expansion port 530 on the second side 508. In step 712, the stacked waveguide circulator 910 directs the returned antenna signal to the receive port 524 on the first side 504 of the stacked waveguide circulator 508. In various embodiments, the expansion port 530 is terminated thereby forcing the signal to another port. In some embodiments, the expansion port 530 does not exist.

In step 714, the stacked waveguide circulator receives a second transmission signal by the expansion port 530. In step 716, the stacked waveguide circulator 508 directs the signal to the antenna port 528 on the second side. In some embodiments, the stacked waveguide circulator 508 directs the signal to the antenna port 528 based on the top magnet 526 and/or the bottom magnet 532. In various embodiments, the stacked waveguide circulator 508 directs the signal to other ports which return the signal such that the signal is ultimately directed to the antenna port 528 in turn.

Figure 8:
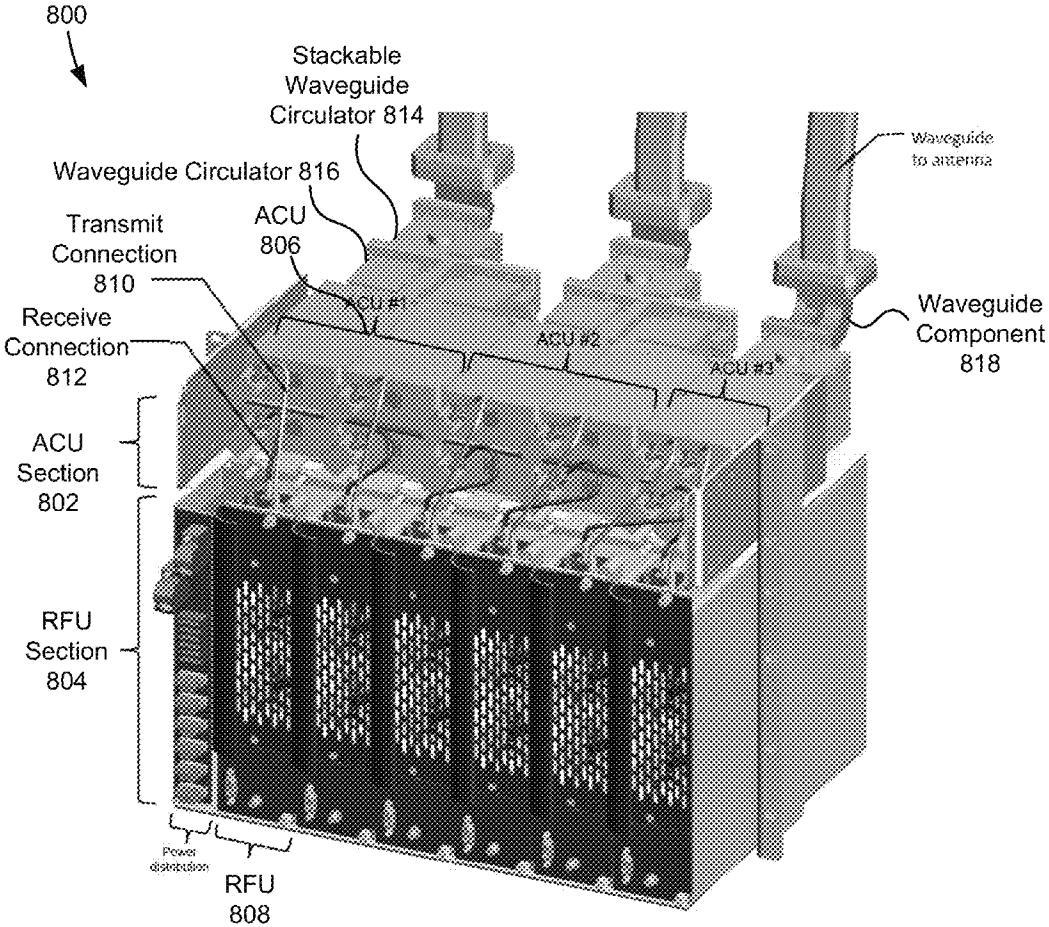
FIG. 8 depicts a rack with three ACUs in an ACU section, six RF units in an RFU section, and two stacked waveguide circulators in some embodiments.

FIG. 8 depicts another rack with three ACUs 806 including stacked waveguide filters, an RF unit section 804, and stacked waveguide circulators in some embodiments. In various embodiments, multiple configurations are possible by stacking filters in differing arrangements and utilizing common building block components.

Figure 9:
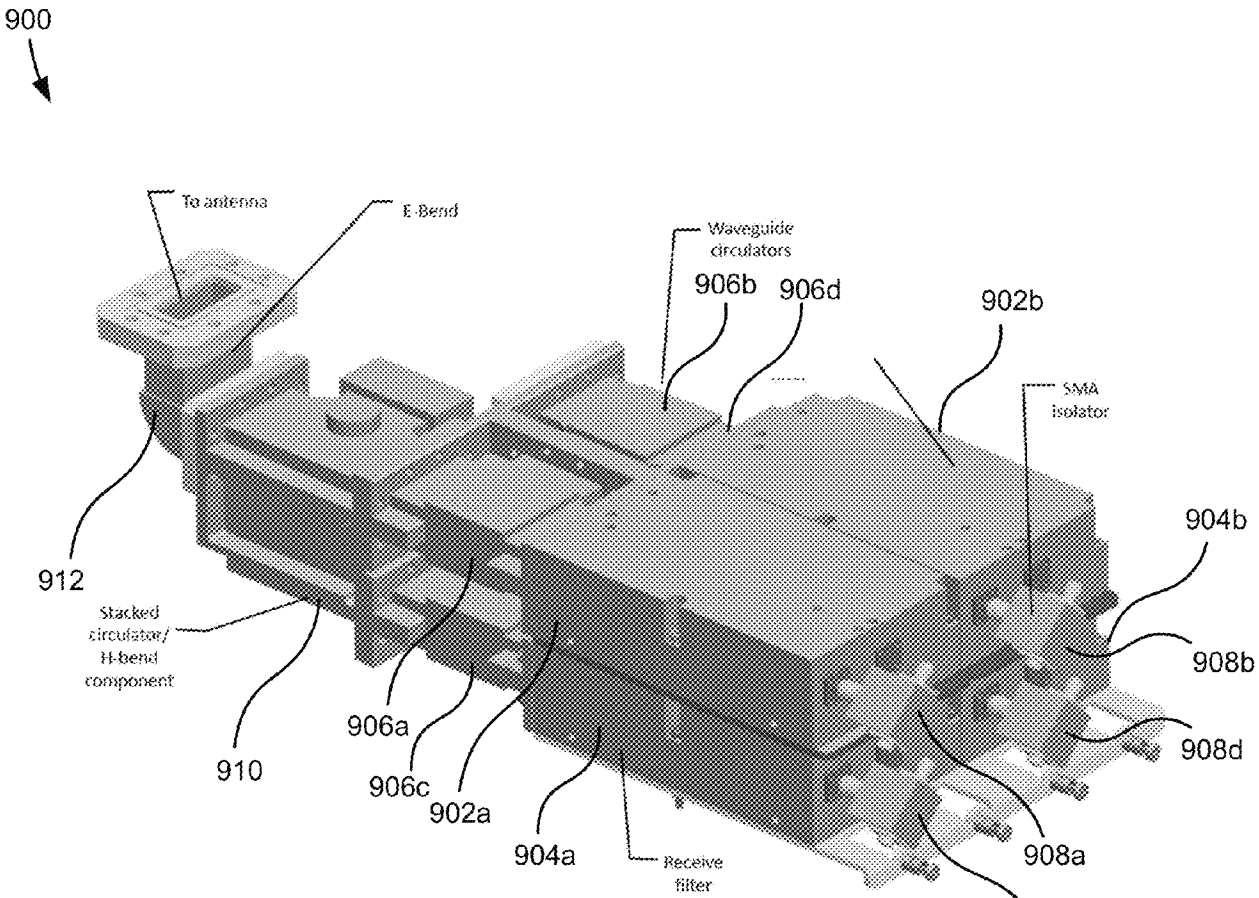
FIG. 9 depicts a compact ACU with a stacked waveguide circulator, four waveguide circulators, four filters, and a waveguide component in some embodiments.

FIG. 8 depicts a rack 800 with three ACUs 806 in an ACU section 804, six RF units 808 in RFU section 804, and two stacked waveguide circulators in some embodiments. Unlike the ACUs of FIG. 5 which comprise one transmit filter, one receive filter, and a stacked waveguide circulator, the first two ACUs 806 (i.e., ACU #1 and ACU #2) each comprise two transmit filters, two receive filters, four waveguide circulators, and a stacked waveguide circulator. The first ACU 806 is depicted in FIG. 9. As a result of using the expanded ACUs, fewer waveguide components 818 to the antenna (e.g., an E-bend, H-bend, or other waveguide that may direct a signal to or from an antenna) may be required. For example, the rack 200 in FIG. 2 may require five waveguide components 216 to the antenna while the rack 800 may require only three waveguide components 818 to the antenna.

The RFU section 804 houses multiple RF units (RFUs) 808. Like RFU 208 of FIG. 2, each RFU 808 may comprise a transmitter and/or a receiver configured to provide signals to and receive signals from an antenna via at least one of the waveguides to the antenna 818, waveguide circulator, and ACU. Each RFU 808 has a transmitter output 810 and receiver input 812 that are connected via coaxial cable to an ACU 806. Each ACU may comprise two transmit filters and two receive filters. Each filter of the ACU may be coupled with one waveguide circulator 816. Each waveguide circulator 816 may be coupled to at least one filter and another waveguide circulator. Two waveguide circulators 816 may be further coupled to a single side of the stacked waveguide circulator 814 (e.g., see FIGS. 10*a* and 10*b*) which, in turn, is coupled to the waveguide 818 to the antenna.

In various embodiments, not all ACUs are similar. For example, ACU #1 comprises two transmit filters, two receive filters, eight waveguide circulators 816, and one stacked waveguide circulator 814. ACU #3 comprises one transmit filter, one receive filter, and one stacked waveguide circulator 814. Those skilled in the art will appreciate that many different configurations, even on a single rack, 800 may be available using the stacked waveguide circulator 814.

Although FIG. 8 depicts six RFU sections 804, three ACUs 806, eight waveguide circulators 816, three stacked waveguide circulators 814, and three waveguide components 818, those skilled in the art will appreciate that there may be any number of RFU sections 804, ACUs 806, waveguide circulators 816, stacked waveguide circulators 814, and waveguide components 818.

FIG. 9 depicts a compact ACU 900 with a stacked waveguide circulator 908, four filters 902*a-b* and 904*a-b*, and four waveguide circulators 906*a-d* in some embodiments. FIG. 9 depicts an ACU configuration utilizing the stacked filter approach and another stacked waveguide circulator 910 labeled as a stacked circulator/H-bend component. In this ACU configuration, two transmit signals may be filtered and combined using waveguide circulators 906*a-b* attached to the rear of the transmit filters 902*a-b*. Two receive signals are filtered and combined using waveguide circulators 906*c-d* attached to the rear of the receive filters 904*a-b*. The transmit and receive signals may be combined using the stacked waveguide circulator 910.

The ACU 900 comprises two transmit filters 902*a-b*, two receive filters 904*a-b*, four SMA isolators 908*a-d*, waveguide circulators 906*a-d* (waveguide circulator 906*d* is hidden from view), a stacked waveguide circulator 910, and a waveguide component 912. The stacked waveguide circulator 910 may comprise a terminator.

Unlike the ACU 300 of FIG. 3, the ACU 900 comprises two transmit filters 902*a-b* and two receive filters 904*a-b*. The transmit filters 902*a-b* and receive filters 904*a-b* may be stacked in any way. For example, the two transmit filters 902*a-b* may be side by side and above the receive filters 904*a-b*. Alternately, the receive filters 904*a-b* may be side by side and above the two transmit filters 902*a-b*. In some embodiments the two transmit filters 902*a-b* may be above each other and next two the two receive filters 904*a-b*. Further, the transmit filter 902*a* may be next to receive filter 904*a* and above receive filter 904*b*. The other transmit filter 902*b* may be below receive filter 904*a* and beside receive filter 904*b*. Those skilled in the art will appreciate that the filters may be stacked and/or oriented in any number of ways.

In some embodiments, each transmit filter 902*a-b* and each receive filter 904*a-b* may be coupled to SMA isolators 904*a-d* as well as a waveguide circulators 906*a-d*. In one example, the transmit filter 902*b* may be coupled with waveguide circulator 906*b*. The waveguide circulator 906*b* may be coupled to waveguide circulator 906*a* and, optionally, a terminator. The waveguide circulator 906*b* may be configured to direct signals from the transmit filter 906*b* to the waveguide circulator 906*a*.

The waveguide circulator 906*a* may be coupled to the waveguide circulator 906*b*, the transmit filter 902*a*, and the stacked waveguide circulator 910. In some embodiments, the waveguide circulator 906*a* receives signals from the transmit filter 902*a* and directs the signal to the stacked waveguide circulator 910. The waveguide circulator 906*a* may also receive a signal from the waveguide circulator 906*b* and direct the signal to the stacked waveguide circulator 910. In one example, the waveguide circulator 906*a* directs the signal from the waveguide circulator 906*b* to the transmit filter 902*a*. The transmit filter 902*a* and/or the SMA isolator 904*a* may return the signal to the waveguide circulator 906*a* which may then forward the signal to the stacked waveguide circulator 910. In some embodiments, the waveguide circulator 906*a* provides the signal from the waveguide circulator 906*b* directly to the stacked waveguide circulator 910.

In some embodiments, the waveguide circulator 906*c* may be coupled to the waveguide circulator 906*d*, the receive filter 904*a*, and the stacked waveguide circulator 910. In some embodiments, the waveguide circulator 906*c* receives signals from the stacked waveguide circulator 910 and directs the signal to the receive filter 904*a*. The waveguide circulator 906*c* may receive a signal from the stacked waveguide circulator 910 that is over a channel which the receive filter 904*a* and/or the SMA isolator 908*c* may not accept. In one example, the receive filter 904*a* and/or the SMA isolator 908*c* may return the signal to the waveguide circulator 906*c* which may direct the signal to the waveguide circulator 906*d*. The waveguide circulator 906*d* may direct the signal from the waveguide circulator 906*c* to the receive filter 904*b*. The waveguide circulator 906*d* may also be coupled with a terminator in some embodiments.

Those skilled in the art will appreciate that the waveguide circulators 906*b* and *d* may be optionally replaced with E-bend or H-bend waveguides. In some embodiments, the waveguide circulators 906*b* and *d* may be coupled to another waveguide, filter, waveguide circulator, stacked waveguide circulator, or other component.

The transmit filters 902*a-b* may be similar filters or have different filtering properties. Similarly, the receive filter 904*a-b* may also be similar filters or have different filtering properties. One or more of the transmit filters 902*a-b* may be similar to the transmit filter 302. One or more of the receive filters 904*a-b* may be similar to the receive filter 304. Further, one or more of the waveguide circulators 906*a-d* may be similar to the other or have different properties (e.g., some of the waveguide circulators may be clockwise circulators while others may be counterclockwise). Moreover, the SMA isolators 908*a-d* may be similar to each other or have different properties.

The stacked waveguide circulator 910 may comprise two ports on one side and one or more ports on another side. In some embodiments, the stacked waveguide circulator 910 may be coupled to the waveguide circulator 906*a* and waveguide circulator 906*c* on one side. The two ports and the two waveguide circulators may be positioned one above the other. The stacked waveguide circulator 910 may also comprise a port that is coupled to a waveguide component 912 (e.g., an E-bend) that is configured to provide energy to the antenna. The stacked waveguide circulator 910 may direct signals from one port on one side of the circulator to at least one of the two ports on another side. The stacked waveguide circulator 910 may comprise an interior structure that defines a cavity that may receive and provide signals to the port to the antenna as well as the ports to the waveguide circulator 906*a* as well as the waveguide circulator 906*c*.

The waveguide component 912 may couple a port on the second side of the stacked waveguide circulator 910 to the antenna. Although an E-bend is depicted in FIG. 9, those skilled in the art will appreciate that any waveguide may be used (e.g., H-bend).

Figures 10A, 10B:
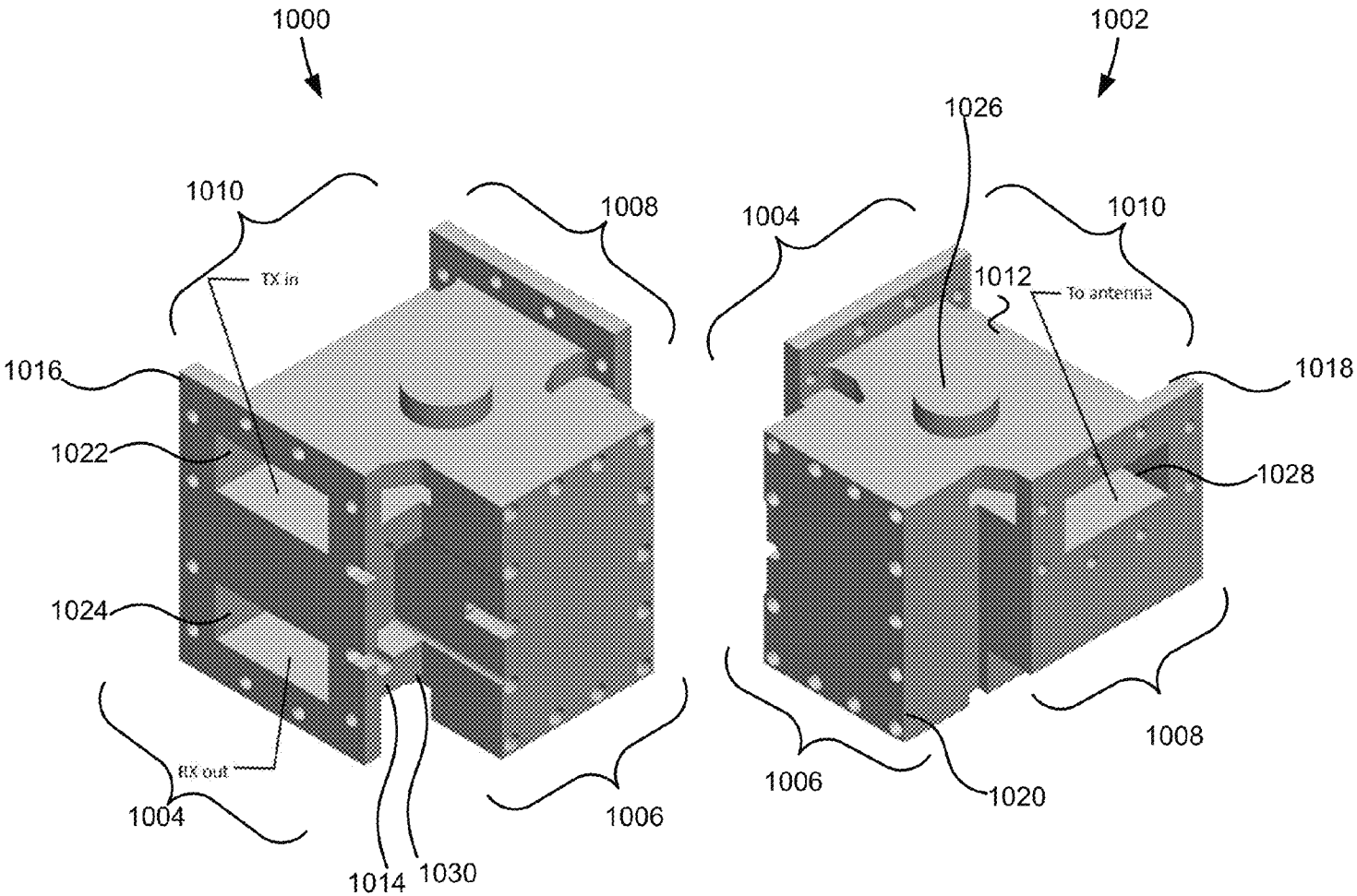
FIG. 10*a* depicts a view of a first and second side of a stacked waveguide circulator without a terminator port in some embodiments.
FIG. 10*b* depicts a view of a second and third side of a stacked waveguide circulator in some embodiments.

FIG. 10*a* depicts a view of first and second sides (sides 1004 and 1006) of a stacked waveguide circulator 1000 in some embodiments. FIG. 10*b* depicts a view of second and third sides (sides 1006 and 1008) of the stacked waveguide circulator in some embodiments. In various embodiments, the stacked waveguide circulator 1000 is a non-reciprocal ferrite device. The stacked waveguide circulator 1000 comprises four sides 1004, 1006, 1008, and 1010. Side 1004 of the stacked waveguide circulator 1000 comprises two ports including a transmit port 1022 which is vertically above a receive port 1024. Side 1008 comprises a single antenna port 1028 (See FIG. 10B).

FIG. 10*a* depicts the stacked waveguide circulator 1000 which allows the filters to be stacked. In some embodiments, stacked waveguide circulator 1000 may be a unique building block that enables a large variety of ACU configurations to be constructed from common blocks while minimizing the space consumed. In various embodiments, the stacked waveguide circulator 1000 may function as an interconnected waveguide circulator and H-bend in a compact space. The transmit and receive ports may be at one end of the stacked waveguide circulator 1000.

The stacked waveguide circulator 1000 comprises a top 1012 opposite a bottom 1014. Transmit port 1022 may be positioned vertically above the receive port 1024 (i.e., towards the top 1012 of the stacked waveguide circulator 1000). Similarly, antenna port 1028 may be at any position of the side 1008 (e.g., towards the top 1012, towards the bottom 1014, or in the center). Side 1004 also includes a flange 1016. Side 1008 may include a flange 1018. The flanges 1016 and 1018 may be configured to couple to two or more waveguide components such as a waveguide filter (e.g., receiving waveguide filter or transmission waveguide filter) or waveguide component.

Multiple waveguide components may be coupled to a flange. For example, flange 1016 may be coupled to a transmit filter (e.g., the transmit filter being coupled to the transmit port 1022) and a receive filter (e.g., the receive filter being coupled to the receive port 1024). The transmit filter and receive filter may be stacked, one over the other, and coupled to the same flange 1016. Similarly, flange 1018 may also be coupled to multiple waveguide components. For example, the flange 1018 may be coupled to a waveguide component (i.e., a waveguide component that is coupled either directly or indirectly to an antenna). The waveguide component may be coupled to antenna port 1028. Further, the flange 1018 may also be coupled to a terminator, receive filter, stacked waveguide circulator, transmit filter, E-bend, H-bend, or any other waveguide component.

The stacked waveguide circulator 1000 may also comprise a magnet 1026 at the top 1012 of the stacked waveguide circulator 1000. In various embodiments, sides 1006 and 1010 do not have any ports. Side 1006 may comprise a removable section 1020.

The magnet 1026 may assist in directing signals between ports. The magnet may be any magnetic material including, but not limited to, a rare earth magnet. In various embodiments, the magnet 1026 assists in directing signals in a non-reciprocal manner. The magnetic fields of the magnet 1026 may redirect the signals between the different ports.

In various embodiments, the stacked waveguide circulator 1000 may be a clockwise or counterclockwise circulator. For example, transmission signals entering the transmit port 1022 may exit the antenna port 1028. Signals entering the antenna port 1028 (i.e., receiving signals) may be directed to the receive port 1024.

Figure 11:
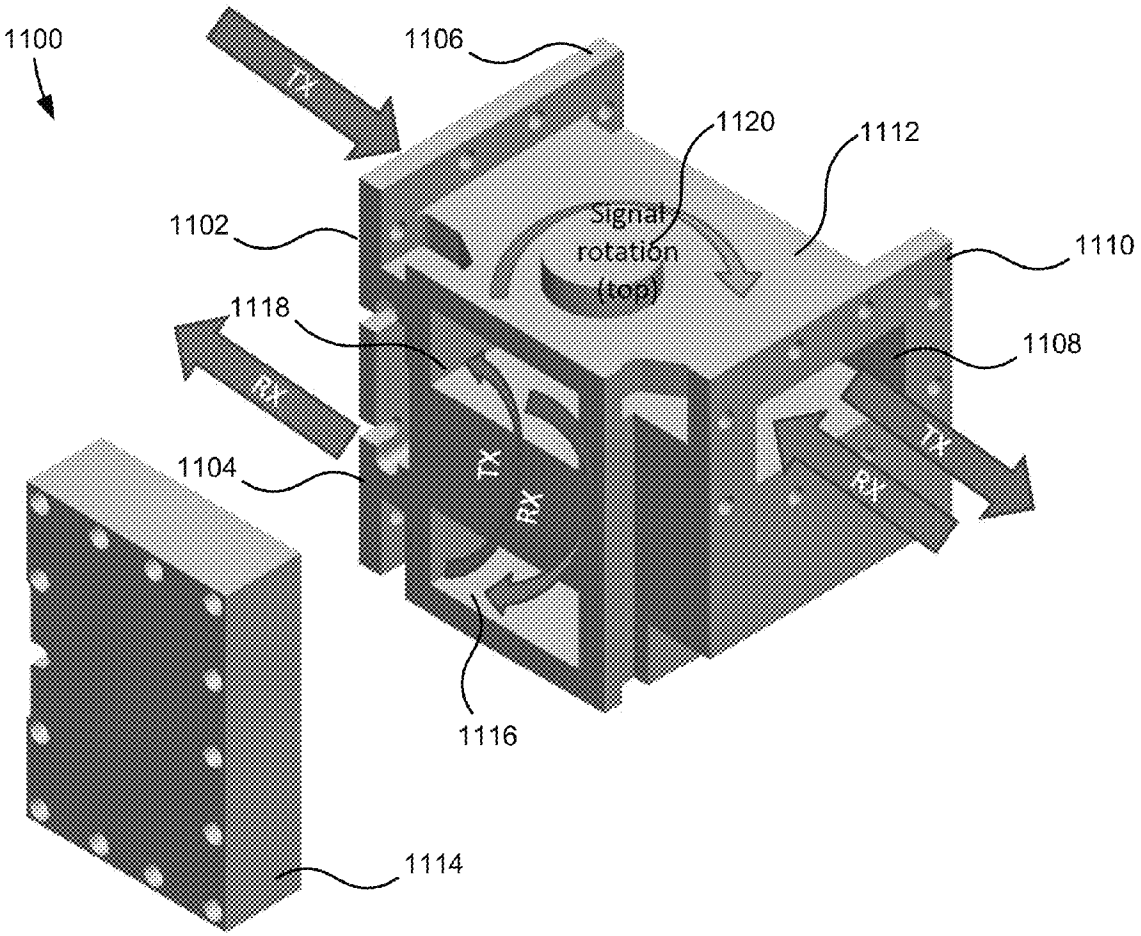
FIG. 11 is an exploded view of the stacked waveguide circulator without a terminator port in some embodiments.

FIG. 11 is an exploded view of the stacked waveguide circulator 1100 without a terminator port in some embodiments. In some embodiments, the section 1014 that couples the top circulator function to the bottom H-bend has been removed. The direction of signal rotation may be shown along with signal paths. By integrating the function of a circulator, an H-bend, and connection waveguide sections into a single component, the space required may be reduced or minimized. In some embodiments, the stacked waveguide circulator 1100 may integrate the function of a circulator, an E-bend, and connection waveguide sections into a single component.

The stacked waveguide circulator 1100 may comprise a transmit port 1102, a receive port 1104, a first flange 1106 on the same side as the transmit port 1102 and the receive port 1104, an antenna port 1008 on a different side, a top 1012, a section 1014, a lower interior 1016, an upper interior 1018, and a magnet 1020. FIG. 11 demonstrates how signals may enter, leave, and circulate within the stacked waveguide circulator 1100. For example, the transmission signal may enter the transmit port 1102 and be directed out of the antenna port 1108 via interior chambers 1016 and/or 1018. Receive signals may be received from the antenna port 1108 and be directed to the receive port 1104. The magnet 1020 may assist in directing the signals between the ports.

In various embodiments, the stacked waveguide circulator 1100 may direct the signal to a port that rejects, reflects, or otherwise returns the signal to the stacked waveguide circulator 600 which may then direct the signal to another port in turn. For example, a signal from the antenna that is to be received by the expansion port 610 may be first be directed to the transmit port 602. A transmitter, transmit filter, and/or SMA isolator may provide the signal back to the transmit port 602. The stacked waveguide circulator 600 may direct the signal to the next port which, in this case, may be the receive port 604. If the signal is not the right carrier, the signal may be rejected, reflected, or otherwise returned to the stacked waveguide circulator 600 which may direct the signal to the expansion receiver on the expansion port 610.

Figure 12:
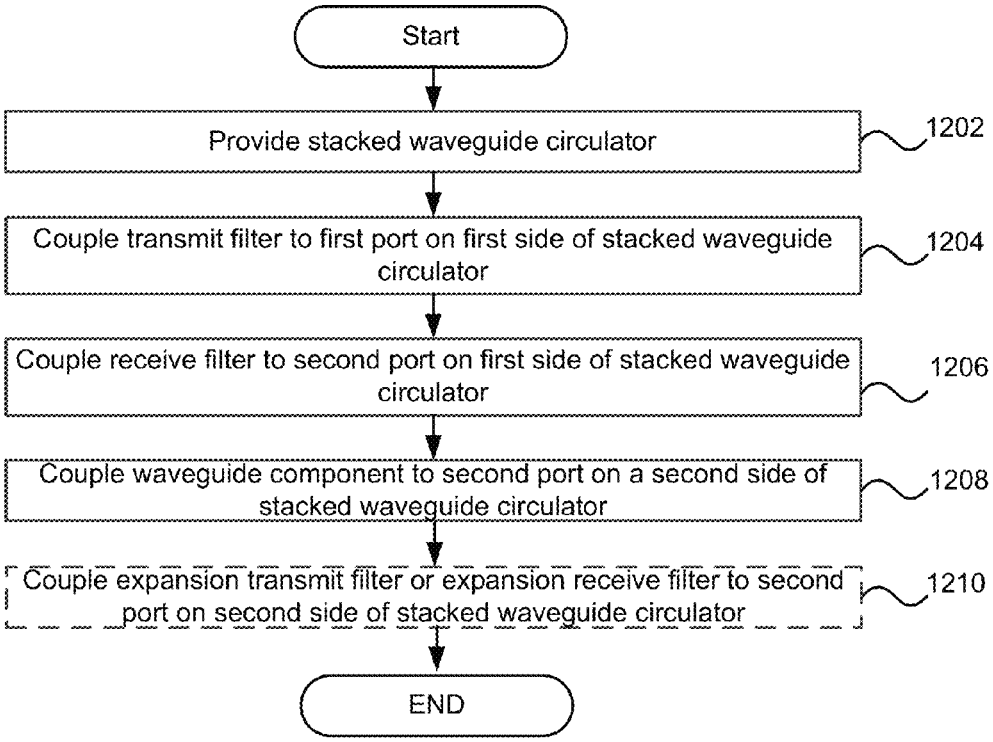
FIG. 12 is a flowchart depicting a method of installing the stacked waveguide circulator without a terminator port in some embodiments

FIG. 12 is a flowchart depicting a method of installing the stacked waveguide circulator in some embodiments. In step 1202, a stacked waveguide circulator is provided. The stacked waveguide circulator may comprise a first side and a second side. The second side may be opposite or adjacent to the first side. The stacked waveguide circulator may comprise two ports on the first side. A first port on the first side may be located above the second port on the first side such that components coupled to each of the ports may be stacked. In some embodiments, the second side also comprises two ports. The first port on the second side may be located above the second port on the second side. The second port may be terminated. Alternately, the second side may comprise only a single port. Those skilled in the art will appreciate that there may be any number of ports on the first and second sides of the stacked waveguide circulator.

In step 1204, a transmit filter is coupled to the first port on a first side of the stacked waveguide circulator. In step 1206, a receive filter is coupled to the second port on the first side of the stacked waveguide circulator. The transmit filter and the receive filter may be stacked. The transmit filter and the receive filter may be coupled to a flange on the first side. Those skilled in the art will appreciate that the transmit filter may be below the receive filter.

In step 1208, a waveguide component (e.g., E-bend or H-bend) may be coupled to the third port on the second side of the stacked waveguide circulator. The waveguide component may be coupled to the first port on the second side via a flange.

In optional step 1210, an expansion transmit filter or expansion receive filter is coupled to the second port on the second side of the stacked waveguide circulator. The expansion transmit filter or expansion receive filter may be coupled to the flange on the second side of the stacked waveguide circulator. In some embodiments, the second port is terminated. In other embodiments, there is only one port on the second side of the stacked waveguide circulator.

Those skilled in the art will appreciate that the transmit and receive filters may be coupled with one or more radio frequency units that may be in a rack. The stacked waveguide circulator, filters, radio frequency units, and antenna may be a part of a peer-to-peer microwave communications system.

In various embodiments, a first and second waveguide circulator may be coupled to the first and second ports of the stacked waveguide circulator. The first and second waveguide circulators may be stacked. The first and second waveguide circulators may each be coupled to another waveguide circulator as well as a filter (e.g., transmit or receive filter). The other waveguide filters may, in turn, be attached to different transmit or receive filters. The filters may be coupled with receivers or transmitters in radio frequency units that are in a rack. The stacked waveguide circulator may also be coupled to a waveguide component that directs energy to the antenna. The stacked waveguide circulator, waveguide circulators filters, radio frequency units, and antenna may also be a part of a peer-to-peer microwave communications system.

Various embodiments are described herein as examples. It will be apparent to those skilled in the art that various modifications may be made and other embodiments can be used without departing from the broader scope of the present invention. Therefore, these and other variations upon the exemplary embodiments are intended to be covered by the present invention(s).

What is claimed is:

1. A stacked waveguide circulator, comprising:

a first side and a second side;

a top and a bottom opposite the top, the top and bottom being adjacent to the first and second sides;

a first port and a second port on the first side, the first port being vertically above the second port on the first side, the first port being coupled to a transmit filter, and the second port being coupled to a receive filter;

a third port on the second side; and a first magnet on the top, the first magnet configured to assist in directing signals from the first port on the first side to the third port on the second side, and in directing signals from the third port on the second side to the second port on the first side.

2. The stacked waveguide circulator of claim 1, wherein an internal structure of the stacked waveguide circulator defines a central cavity configured to receive signals from the first, second, and third ports.

3. The stacked waveguide circulator of claim 1, wherein the third port is coupled to an antenna waveguide, the antenna waveguide being coupled to an antenna.

4. A stacked waveguide circulator, comprising:

a first side and a second side;

a top and a bottom opposite the top, the top and bottom being adjacent to the first and second sides;

a first port and a second port on the first side, the first port being vertically above the second port on the first side, the first port being coupled to a first transmit filter, and the second port being coupled to a first receive filter;

a third port and a fourth port on the second side, the third port being vertically above the fourth port;

a first magnet on the top, the first magnet configured to assist in directing signals from the first port on the first side to the third port on the second side; and a second magnet on the bottom, the second magnet configured to assist in directing signals from the third port on the second side to the fourth port on the second side, and in directing signals from the fourth port on the second side to the second port on the first side.

5. The stacked waveguide circulator of claim 4, wherein an internal structure of the stacked waveguide circulator defines a central cavity configured to receive signals from the first, second, third, and fourth ports.

6. The stacked waveguide circulator of claim 4, wherein the third port is coupled to an antenna waveguide, the antenna waveguide being coupled to an antenna.

7. The stacked waveguide circulator of claim 4, wherein the fourth port is coupled to a second transmit filter or a second receive filter.

8. A system comprising:

a stacked waveguide circulator comprising a first side, second side, top and bottom, the top being opposite the bottom, the top and bottom being adjacent to the first and second sides, the first side further comprising a first port and a second port, the first port being above the second port, the second side further comprising a third port, and the top of the stacked waveguide circulator comprising a first magnet;

a first transmit filter coupled to a first transmitter and the first port on the first side of the stacked waveguide circulator;

a first receive filter coupled to a first receiver and the second port on the first side of the stacked waveguide circulator, wherein the first receive filter is stacked with the first transmit filter; and an antenna waveguide coupled to the third port on the second side of the stacked waveguide circulator, the stacked waveguide circulator being configured to receive a first signal from the first transmit filter via the first port and direct the first signal to the antenna waveguide via the third port, and to receive a second signal from the antenna waveguide via the third port and direct the second signal to the first receive filter via the second port.

9. The system of claim 8, wherein the second side of the stacked waveguide circulator further comprises a fourth port and the bottom of the stacked waveguide circulator comprises a second magnet configured to direct signals to or from the fourth port.

10. The system of claim 9, further comprising a second transmit filter coupled to a second transmitter and to the fourth port, wherein the stacked waveguide circulator is configured to receive a signal from the second transmitter via the second transmit filter over the fourth port and direct the signal to the antenna waveguide via the third port.

11. The system of claim 9, further comprising a second receive filter coupled to a second receiver and to the fourth port.

12. The system of claim 11, wherein the stacked waveguide circulator is configured to receive a signal from the antenna waveguide via the third port and direct the signal to the second receiver via the second receive filter via the fourth port.

13. A system comprising:

a stacked waveguide circulator comprising a first side, second side, top and bottom, the top being opposite the bottom, the top and bottom being adjacent to the first and second sides, the first side further comprising a first port and a second port, the first port being above the second port, the second side further comprising a third port, and the top of the stacked waveguide circulator comprising a first magnet;

a first transmit filter coupled to a transmitter and the first port on the first side of the stacked waveguide circulator;

a first receive filter coupled to a receiver and the second port on the first side of the stacked waveguide circulator, wherein the first receive filter is stacked with the first transmit filter; and an antenna waveguide coupled to the third port on the second side of the stacked waveguide circulator, the stacked waveguide circulator being configured to receive a first signal from the antenna waveguide via the third port and direct the first signal to the first transmit filter via the first port, and to receive the first signal from the first transmit filter via the first port and direct the first signal to the first receive filter via the second port.

14. The system of claim 13, wherein the first transmit filter is configured to receive the first signal from the stacked waveguide circulator via the first port and return the first signal to the stacked waveguide circulator via the first port.

15. The system of claim 14, wherein the first signal is returned because the first signal is rejected by the first transmit filter.

16. A system comprising:

a stacked waveguide circulator comprising a first side, second side, top and bottom, the top being opposite the bottom, the top and bottom being adjacent to the first and second sides, the first side further comprising a first port and a second port, the first port being above the second port, the second side further comprising a third port, and the top of the stacked waveguide circulator comprising a magnet;

a receive filter coupled to a receiver and the first port on the first side of the stacked waveguide circulator;

a transmit filter coupled to a transmitter and the second port on the first side of the stacked waveguide circulator, wherein the transmit filter is stacked with the receive filter; and an antenna waveguide coupled to the third port on the second side of the stacked waveguide circulator, the stacked waveguide circulator being configured to receive signals from the transmit filter and an antenna filter and provide signals to the antenna filter and the receive filter.

17. A method comprising:

receiving, by a stacked waveguide circulator, a first signal from a transmitter, the first signal being received by a first port on a first side of the stacked waveguide circulator;

directing, by the stacked waveguide circulator, the first signal to an antenna via a third port on a second side of the stacked waveguide circulator;

receiving, by the stacked waveguide circulator, a second signal from the antenna via the third port of the stacked waveguide circulator; and directing, by the stacked waveguide circulator, the second signal from the antenna to a receiver via a second port, the second port being on the first side of the stacked waveguide circulator and being vertically below the first port.

18. A method comprising:

means for receiving, by a stacked waveguide circulator, a first signal from a transmitter, the first signal being received by a first port on a first side of the stacked waveguide circulator;

means for directing, by the stacked waveguide circulator, the first signal to an antenna via a third port on a second side of the stacked waveguide circulator;

means for receiving, by the stacked waveguide circulator, a second signal from the antenna via the third port of the stacked waveguide circulator; and means for directing, by the stacked waveguide circulator, the second signal from the antenna to a receiver via a second port, the second port being on the first side of the stacked waveguide circulator and being vertically below the first port.

* * * * *